US005234245A

United States Patent [19]

Peterson et al.

[11] Patent Number: 5,234,245

[45] Date of Patent: Aug. 10, 1993

[54] RECYCLABLE STRAP FOR HANDLING EMPTY PLASTIC JUGS

[76] Inventors: Kevin R. Peterson; Joan B. Peterson, both of 3 Forest Rd., Stow, Mass. 01775

[21] Appl. No.: 746,351

[22] Filed: Aug. 16, 1991

[51] Int. Cl.[5] ..... B65B 17/02; B65D 71/02

[52] U.S. Cl. ..... 294/158; 294/149; 294/159

[58] Field of Search ..... 294/27.1, 31.2, 74, 294/87.2, 137, 149, 145, 150, 152–159, 161, 164–166, 170, 141–143; 24/16 R, 16 PB, 17 R, 17 AP, 17 A, 17 B, 18; 206/139, 150, 162, 427, 428, 142, 143, 163, 199; 215/100 R, 100 A; 224/103, 255, 256

[56] References Cited

U.S. PATENT DOCUMENTS

| | | | |
|---|---|---|---|
| 1,560,938 | 11/1925 | Lund | 294/158 |
| 2,616,568 | 11/1952 | Bundgus | 294/161 X |
| 2,970,729 | 2/1961 | Allen | 294/149 |
| 2,972,438 | 2/1961 | Kimbrough | 224/103 |
| 3,143,265 | 8/1964 | Ruderian | 294/158 X |
| 3,143,266 | 8/1964 | Imatake | 294/31.2 X |
| 3,297,220 | 1/1967 | Leeberg | 294/149 |
| 3,314,712 | 1/1965 | Hohl et al. | 294/87 |
| 3,402,910 | 9/1968 | Purvis | 294/31.2 X |
| 3,709,544 | 1/1973 | Oltmanns | 294/31.2 |
| 4,004,683 | 1/1977 | Pomeroy et al. | 206/3 |
| 4,015,762 | 4/1977 | Mendillo | 294/164 X |
| 4,033,457 | 7/1977 | Weaver | 206/390 |
| 4,651,873 | 3/1987 | Stolcenberg et al. | 206/142 |
| 4,798,286 | 1/1989 | Muscarelli | 206/150 |
| 4,826,231 | 5/1989 | Bakhit | 294/158 |
| 4,911,289 | 3/1990 | Bird | 206/150 |

FOREIGN PATENT DOCUMENTS

| | | | |
|---|---|---|---|
| 653615 | 11/1937 | Fed. Rep. of Germany | 294/161 |
| 677353 | 6/1939 | Fed. Rep. of Germany | 294/150 |
| 535145 | 4/1922 | France | 294/149 |
| 1389928 | 4/1975 | United Kingdom | 294/154 |

OTHER PUBLICATIONS

"Re-Using Our Riches", The Stow Villager, May 17, 1991, by Stow's Recycling Committee.

*Primary Examiner*—Johnny D. Cherry

[57] ABSTRACT

A recyclable strap for holding, storing, toting, and returning empty recyclable plastic jugs. The strap has a hole at either end. One end of the strap is threaded through a plastic jug handle and the hole at the other end of the strap. The strap cinches on the handle of the jug forming a stop and may then be suspended using the hole at the free end of the strap. Multiple jugs may then be threaded on the strap through their handles. The strap is then used for transporting the jugs and can be recycled with the jugs.

4 Claims, 2 Drawing Sheets

RECYCLABLE STRAP FOR HANDLING EMPTY PLASTIC JUGS

FIELD OF THE INVENTION

This invention relates to the storage, transport, and return of empty recyclable jugs, for example, plastic milk jugs.

BACKGROUND OF THE INVENTION

Many consumer fluids are sold in plastic jugs, which are typically made of a recyclable plastic. Most jugs, for instance milk jugs or bleach jugs, are typically made from Type 2 HDPE plastic. For the purpose of the discussion the term, "jug", refers to bottles with integral, closed loop handles which are made of a recyclable plastic. The term, "consumer", in this discussion refers to the person who uses the contents of the jug and then returns the jug for recycling.

It is a common and encouraged practice to recycle plastic jugs. This practice requires storage, transport, and return of the jugs. There are two primary channels for recycling jugs, recycling centers and curbside pickup. When returning jugs to a recycling center, the consumer is required to carry the jugs from the home to the center. This typically requires use of an automobile or similar mode of transportation. When using curbside pickup for recycling jugs, the consumer is typically required to sort recyclables and then carry them to the curb where a recycling agent will pickup the jugs. In some cases the recycling agent is required to sort the recyclables.

An unfortunate characteristic of the jugs is that they typically occupy a large volume, which places certain constraints on their handling. Additionally, empty jug are very light-weight and slippery. As a result, it is extremely difficult handling several jugs at one time.

The most common method for handling jugs is using a larger holding container. Large plastic garbage bags or large bins are frequently used. However, these mechanisms are typically cumbersome, since such containers require much floor space themselves, are awkward to carry, are difficult to transport in most automobiles, and do not hold many jugs. Another problem with recycling containers is that they do not tend to keep the jugs upright and any residue in the jugs can leak into the container. Also, the container itself requires additional transport once the jugs have been disposed of.

Another method for handling jugs would be to use a strap similar to that embodied in U.S. Pat. No. 4,798,286 to Muscanelli (1987). Such a flat strap has openings used to accept the neck of a bottle. Although this method may be adequate for refundable soft drink bottles, it is not effective for jugs due to the variability in jug sizes and neck diameters, the absence of a neck flange, and additional work required to remove the jugs from the strap. Indeed, it is doubtful that this method has ever been reduced to practice.

OBJECTS AND ADVANTAGES

Accordingly, an object of the present invention is that it aids and improves all aspects of handling of recyclable jugs.

The primary advantage of this invention is that it permits vertical storage of jugs. With this recycling strap, jugs may be hung from a hook on a wall or a door, the hanger hook in an automobile, or a utility hook on a garbage can. This is advantageous since it reduces the need for floor space, which is typically taken up with containers for other recyclables such as newspaper, glass jars, aluminum cans, et al. This is especially important for storage and transport of jugs, since they take up a relatively large volume compared to that of other recyclables.

An additional benefit is that carrying the jugs is facilitated by the strap. A large number of jugs can be easily toted with the strap using a single hand. Most containers require two hands and much clearance.

Another benefit of this invention is that the neck of the jug is held upright preventing residue in the jug from spilling out. This feature is particularly important when transporting the jugs, since it prevents spills in and out of the home or in an automobile.

A further benefit of the strap is that it is small, lightweight, inexpensive, requires little material, and can be made of a recycled plastic compatible with the jugs to be recycled. For instance, a strap made from Type 2 HDPE plastic may be recycled with jugs of that type. In the latter case, the strap binds the compatible type jugs through all steps of the return cycle, simplifying the sorting task of the recycling agent. Alternatively, the strap may be reused. The consumer can easily slide the jugs off the strap at the recycling center and retain the strap for future use.

DRAWING FIGURES

In the drawings FIGS. 1, 2, and 3 show several embodiments of the present invention, while FIGS. 4A, 4B, and 4C show the operation of the preferred embodiment of the invention.

FIG. **4*a*** is a view of the recycling strap cinched on the first jug.

FIG. **4*b*** is a view of the recycling strap holding a plurality of jugs.

FIG. **4*c*** is a view of the recycling strap holding a plurality of jugs and securing the last jug.

DESCRIPTION

Figure 1:
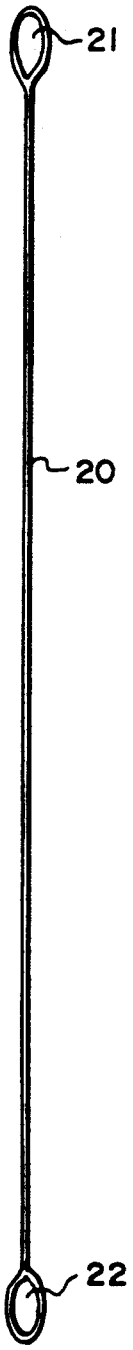
FIG. 1 is a view of a recycling strand in its simplest form having loops at either end.
Figure 2:
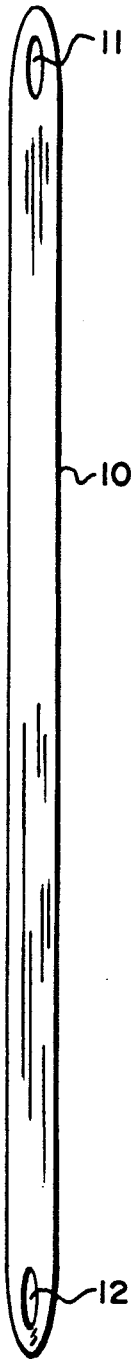
FIG. 2 is a frontal view of a recycling strip in its simplest form having slots at either end.
Figure 3:
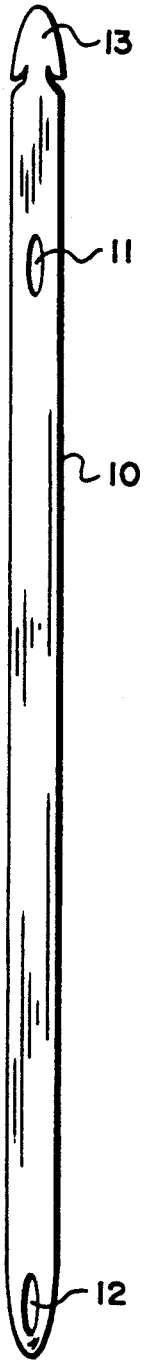
FIG. 3 is a frontal view of the recycling strap of the preferred embodiment of the present invention.

The recycling strap of the present invention has several possible forms as shown in FIGS. 1, 2, and 3.

In its simplest form the recycling strap shown in FIG. 1 consists of a long strand 20 with an upper loop 21 and lower loop 22. The strand 20 can be made of a rope, cord, or filament. The loops 21 and 22 can be formed by an eye splice, knot, or heat bonding. In this embodiment the recycling strap would most likely be made of a material that is not compatible with that of the jugs. Hence, this form of the invention would be reusable, but not necessarily recyclable.

In another embodiment depicted in FIG. 2 the recycling strap consists of a narrow plastic strip 10 with an upper slot 11 and lower slot 12 cut out at opposite ends of the strip. In this form the recycling strap shown in FIG. 2 ideally is made of a recyclable plastic which is compatible with the jugs and may be returned with the jugs.

In the preferred embodiment drawn in FIG. 3, the recycling strap consists of a narrow plastic strip 10 with an upper slot 11, a lower slot 12, and a securing interlocking tab 13 above the upper slot 11. In this preferred embodiment the recycling strap also is made of the same type of plastic as the plastic jugs which it supports, since this compatibility facilitates disposal of both the plastic jugs and the strap which binds them.

Although the composition of the strap and implementation of the loops or slots may vary, the purpose of corresponding parts of the invention is identical across implementations. Specifically, the strand 20 of FIG. 1 corresponds to the strip 10 of FIGS. 2 and 3. The upper loop 21 and lower loop 22 in FIG. 1 correspond to the upper slot 11 and lower slot 12 of FIGS. 2 and 3, respectively.

There are several important attributes of the strap. The strap can be made:

- from recycled plastic, for instance Type 2 HDPE, and can itself be recycled.
- thin enough to be light, inexpensive, and represent a small volume (typically less than 1%) of the total recycled plastic.
- flexible enough to knot or cinch.
- strong enough to support a plurality of jugs and not easily break or tear.
- with slots at either end which are wide enough to convey body of the strap.

The present invention has been shown in several embodiments including a preferred embodiment. However, modifications and variations can be made within the spirit of the invention. The present invention, therefore, is not intended to be limited to any specific form or embodiment except as such limitations are expressed in the claims. Furthermore, it is possible to use this invention for purposes other than the handling of plastic jugs. The invention can also be used for the handling of any light-weight objects having an aperture for receiving the strap.

OPERATION

In all embodiments of the present invention, the top of the strap or strand is first threaded through the handle of the first jug and then through the lower slot or loop. The strap or strand is then cinched on that jug forming a stop. The strap or strand may then be suspended from the upper slot or loop by means of a hook. The strap or strand may be removed from the hook in order to thread subsequent jugs and then resuspended.

Figure 4A:
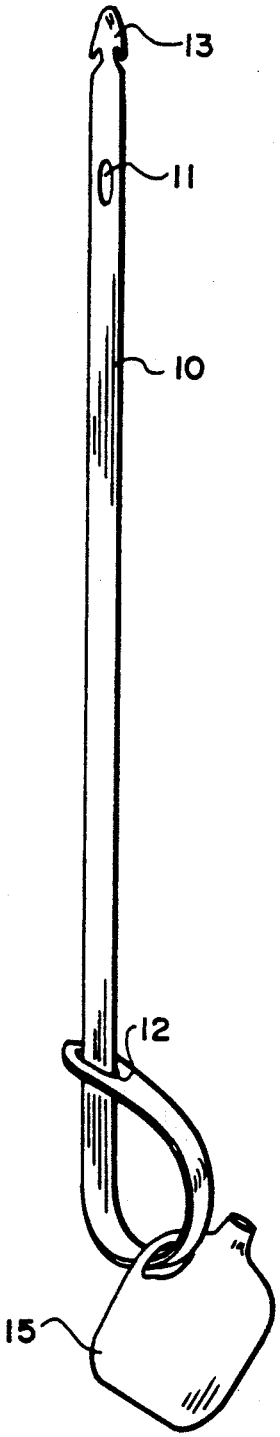
Figure 4B:
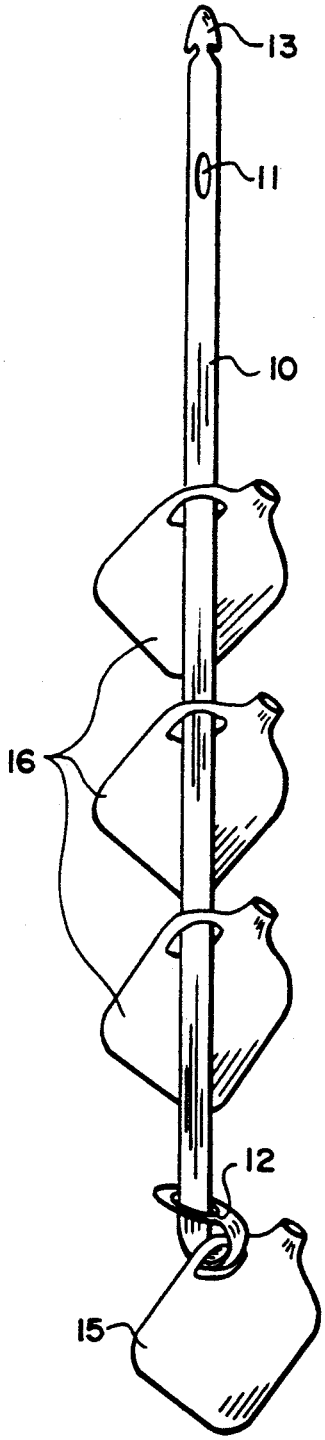
Figure 4C:
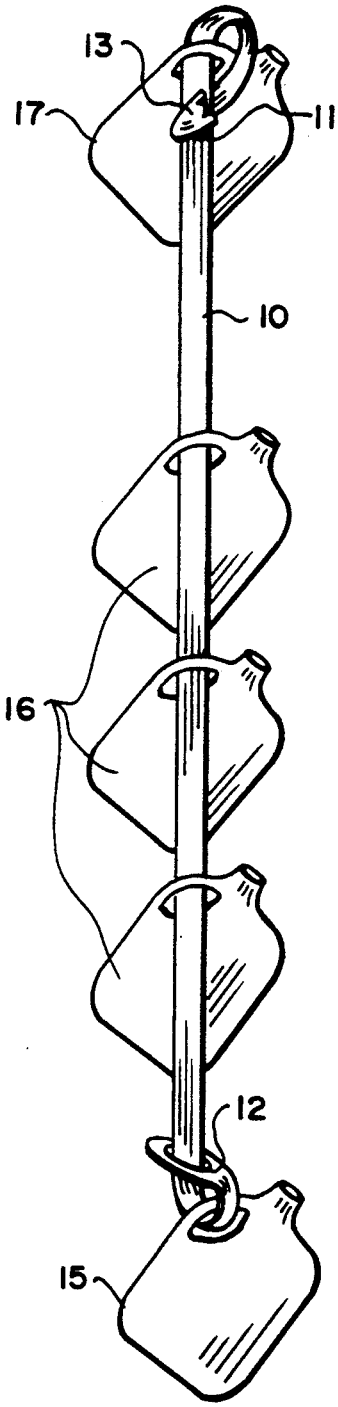

The following paragraphs describe the operation of the preferred embodiment depicted in FIGS. 4A, 4B, and 4C.

FIG. 4A shows how the recycling strap 10 is used to engage the first jug 15. The first jug 15 is secured by threading the top of the strap 10 through the handle of the first jug 15 and then through the lower slot 12 in the bottom end of the strap. The slot 11 in the top of the strap may then be used for hanging or toting the empty jugs.

FIG. 4B shows the strap 10 cinched on the handle of the first jug 15 forming a stop for subsequent jugs 16 threaded on the top of the strap 10. A plurality of jugs may then be threaded in a similar fashion. Again the upper slot 11 maybe used for hanging or carrying. Up to this point any of the embodiments depicted in FIGS. 1, 2, or 3 may be manipulated in the same way.

FIG. 4C shows an important unique feature of the preferred embodiment. In attaching the last jug 17 to the strap 10, the interlocking tab 13 at the top of the strap is threaded through the handle of the last jug 17 and then into the upper slot 11 until the interlocking tab 13 locks securely into the slot 11. The last jug 17 now secured becomes a stop and prevents any of the other jugs 16 from sliding off the top of the strap 10.

This last feature made possible by the interlocking tab 13 is beneficial in that it secures the jugs on the strap without the necessity of a supporting hook and gravity. If the strap complete with a plurality of jugs is dropped, the jugs remain securely fastened. This is particularly important for curbside pickup where the recycling agent does not want to be burdened with picking up loose jugs should a container spill.

We claim:

1. A method of holding a plurality of recyclable containers having handles comprising: providing a flexible strap having a slot formed in one end of said strap, an interlocking tab formed at the other end of said strap, and an aperture formed in said strap in proximity to said interlocking tab; inserting said other end of said strap through the handle of a first of the plurality of recyclable containers and then through said slot; cinching said strap on the handle of the first of the plurality of containers and thereby forming a stop; and inserting said other end of said strap through the handles of the remainder of the plurality of recyclable containers to hold the recyclable containers relative to each other along said strap.

2. The method of claim 1 further comprising: suspending said strap and the plurality of recyclable containers by said aperture.

3. The method of claim 1 further comprising: wrapping the portion of said strap between said interlocking tab and said aperture around the handle of the last of the plurality of recyclable containers; and inserting said interlocking tab into said aperture securing the last of the plurality of recyclable containers and thereby forming a stop and binding the plurality of recyclable containers on said strap.

4. A holder for plastic jugs having handles comprising:

a flexible strap made of the same material as the jugs having a lower end and an upper end with a lower slot formed at said lower end, an upper slot formed near said upper end, and an interlocking tab formed at said upper end;

said lower slot positioned centrally and longitudinally along said strap with a length slightly greater than the width of said strap, said upper slot positioned centrally and longitudinally along said strap at a sufficient distance from said interlocking tab to allow the portion of said strap between said upper slot and said interlocking tab to be wrapped around the handle of a jug, and said interlocking tab formed to insert and engage in said upper slot;

wherein said upper end to thread through the handle of a jug, through said lower slot thereby cinching to form a stop, through the handles of a plurality of jugs, through the handle of a last jug, and said interlocking tab to engage in said upper slot securing the last jug thereby forming another stop binding the plurality of jugs on said strap, subsequently said strap to be suspended for the purpose of storage, transport, and/or recycling of the jugs.

* * * * *